US009520032B2

(12) United States Patent
Polyakov

(10) Patent No.: US 9,520,032 B2
(45) Date of Patent: Dec. 13, 2016

(54) SLOTS JOURNEY GAME

(71) Applicant: DELONACO LIMITED, Nicosia (CY)

(72) Inventor: Maxym Polyakov, Menlo Park, CA (US)

(73) Assignee: Delonaco Limited, Nicosia (CY)

( * ) Notice: Subject to any disclaimer, the term of this patent is extended or adjusted under 35 U.S.C. 154(b) by 216 days.

(21) Appl. No.: 13/913,554

(22) Filed: Jun. 10, 2013

(65) Prior Publication Data

US 2014/0364191 A1 Dec. 11, 2014

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01); *G07F 17/3244* (2013.01)

(58) Field of Classification Search
CPC .... G07F 17/34; G07F 17/3244; G07F 17/326; A63F 13/795; A63F 2300/556
See application file for complete search history.

(56) References Cited

U.S. PATENT DOCUMENTS

| | | | | |
|---|---|---|---|---|
| 8,734,234 | B1 * | 5/2014 | Guase | G07F 17/326 463/16 |
| 2009/0069066 | A1 * | 3/2009 | Yoshizawa | G07F 17/3211 463/20 |
| 2010/0248818 | A1 * | 9/2010 | Aoki et al. | 463/25 |
| 2012/0178515 | A1 * | 7/2012 | Adams et al. | 463/17 |
| 2012/0184363 | A1 * | 7/2012 | Barclay | G06Q 10/10 463/25 |
| 2013/0005441 | A1 * | 1/2013 | Ellis | 463/25 |
| 2013/0172062 | A1 * | 7/2013 | Amaitis | G07F 17/3237 463/13 |
| 2013/0252742 | A1 * | 9/2013 | Shimono | A63F 9/24 463/43 |
| 2014/0018141 | A1 * | 1/2014 | Anikin | G06Q 30/0207 463/16 |

* cited by examiner

*Primary Examiner* — Jasson Yoo
(74) *Attorney, Agent, or Firm* — Sheppard, Mullin, Richter & Hampton LLP

(57) ABSTRACT

A method for a slots game is disclosed. Such a slots game includes simulated gambling elements and adventure elements. Further, such a slots game has a viral effect of attracting members of gamer's social network.

16 Claims, 19 Drawing Sheets

SLOTS JOURNEY GAME

TECHNICAL FIELD

The present invention is directed to a simulated gambling slots game for playing in a social media context including a mobile version.

DETAILED DESCRIPTION

Figure 1:
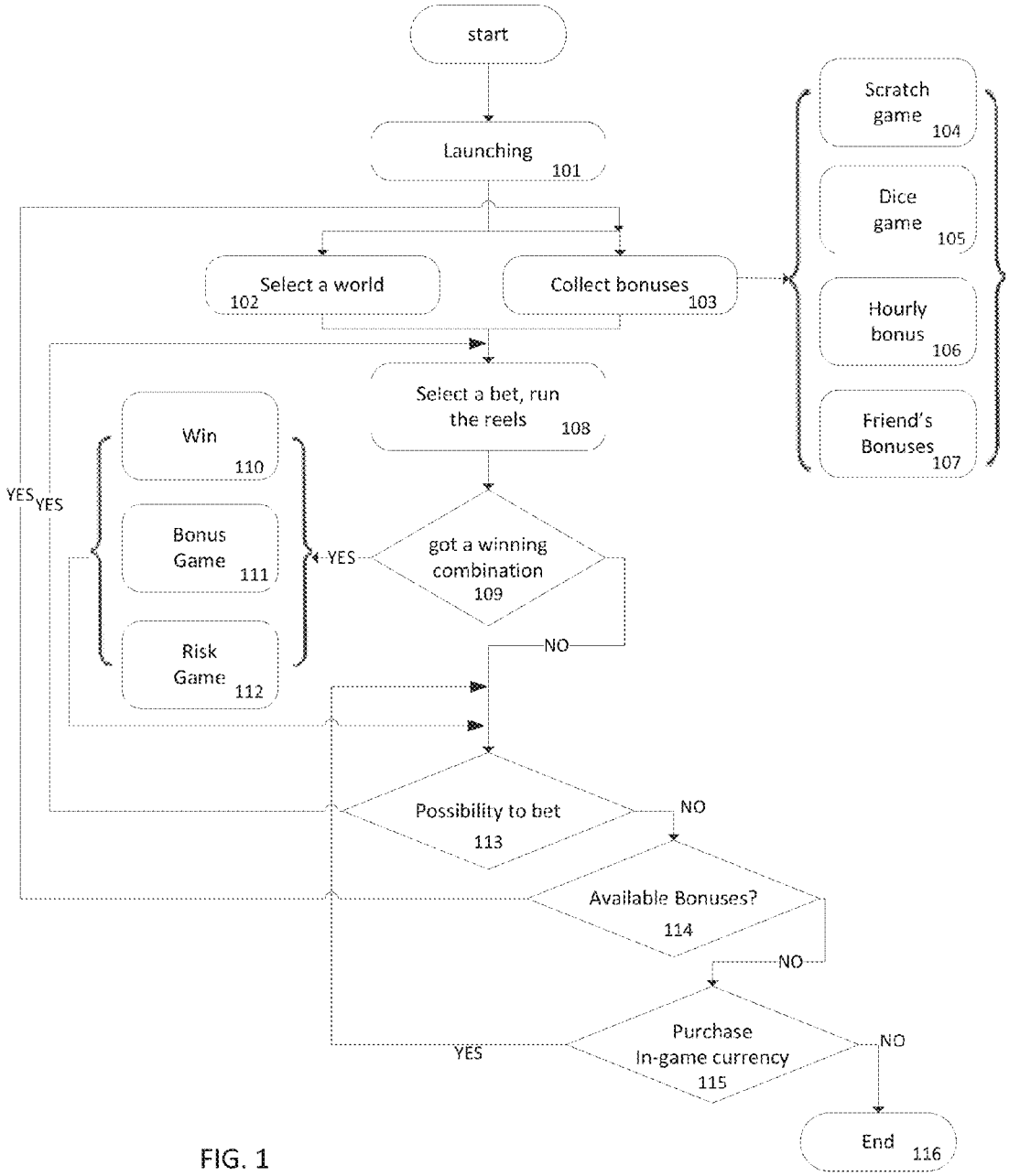
FIG. 1 is a high-level flow chart that illustrates a general scheme for a social media version of the slots journey game, according to certain embodiments.

Methods, systems, user interfaces, and other aspects of the invention are described. Reference will be made to certain embodiments of the invention, examples of which are illustrated in the accompanying drawings. While the invention will be described in conjunction with the embodiments, it will be understood that it is not intended to limit the invention to these particular embodiments alone. On the contrary, the invention is intended to cover alternatives, modifications and equivalents that are within the spirit and scope of the invention. The specification and drawings are, accordingly, to be regarded in an illustrative rather than a restrictive sense.

Moreover, in the following description, numerous specific details are set forth to provide a thorough understanding of the present invention. However, it will be apparent to one of ordinary skill in the art that the invention may be practiced without these particular details. In other instances, methods, procedures, components, and networks that are well known to those of ordinary skill in the art are not described in detail to avoid obscuring aspects of the present invention.

According to certain embodiments, a social media game combines elements of gambling slots and adventure (herein referred to as slots journey game). Certain embodiments include a mobile version of the game. According to certain embodiments, the slots journey game presents "Worlds" and locations and levels within each world to the gamer for playing the game. For example, each World comprises several levels of the slots game. When the gamer first enters a given "World" (Egypt, for example) and the gamer then plays the game in that World by progressing from one location to another (within that World) and from one level to another within a location. When the gamer finishes all the locations and levels associated with a World, then the game presents the next World to the gamer for play. For example, the gamer plays the slots using in-game coins or chips, earns points and moves forward in the locations and levels within the World. According to certain embodiments, one way of obtaining in-game coins or chips is by collecting hourly bonuses in the game. Another way of obtaining in-game coins or chips is by buying the in-game coins or chips using an in-application purchase. For example, the game application can present a user interface, such a tool bar, to the gamer that allows the gamer to purchase in-game coins using a credit card, electronic wallet, SMS payment, or some electronic payment service, etc.

According to certain embodiments, the game includes a virality aspect where the gamer entices her/his friends to the game. According to certain embodiments, the game allows the gamer to purchase boosters and power-ups. According to certain embodiments, a booster is a technique for multiplying the gamer's winnings and enhancing the game experience and is activated before spinning the reel of the slots journey game. According to certain embodiments, a power-up is a technique for changing the positions of one or more reels before spinning the reels when playing the game.

According to certain embodiments, the game includes "bigwins". A bigwin is an amount of winnings that is several times the betting amount. For example, a bigwin can be 10 times the betting amount in the social media version of the slots journey game. As another example, a bigwin can be 5 times the betting amount in the mobile version of the slots journey game.

FIG. 1 is a high-level flow chart that illustrates a general scheme for a social media version of the slots journey game, according to certain embodiments. The slots journey game can be accessed via browsers such as Chrome, Firefox, Opera, etc. The game can also be installed and run on smart devices such as smart phones, smart tablets, smart pads etc.

In FIG. 1, at block 101, the simulated gambling slots journey game is launched. The gamer has the option to select a "world" at block 102, or select the option of collecting bonuses at block 103. If the gamer selects to collect bonuses then the gamer is presented with a variety of ways to collect bonuses. Some non-limiting examples of collecting bonuses include: a scratch game 104, a dice game 105, an hourly bonus 106, and friend's bonuses 107. The scratch game, dice game, hourly bonus and friend's bonuses are described in greater detail herein. If the gamer selects a "world", then the gamer can start playing one of several locations and levels within the world. For example, the game starts at the first location and level if the gamer is just starting the game in that particular world or the gamer can resume at the location and level in which he/she was playing previously.

At block 108, the gamer can select the amount of in-game coins to bet (a bet) and then spin the reels of the slots journey game. At block 109, it is determined if the reels have arrived at a winning combination. For example, a result of a winning combination can include: winning in-game coins 110, winning a bonus game offering 111, or winning a risk game offering 112. The number of in-game coins that is won is calculated based on a pay table that is described in greater detail herein.

If there is no winning combination, then at block 113, it is determined if the gamer has enough in-game coins left in order to place a new bet to continue playing the game. If it is determined that the gamer has enough remaining in-game coins to place a new bet, then the gamer can place a bet and spin the reel again as described with respect to block 108. If it is determined that the gamer does not have any remaining in-game coins, then at block 114 it is determined if there are any bonuses available to the gamer. If it is determined there are bonuses available, then the gamer can collect bonuses as described with respect to block 103. If it is determined there are no bonuses available, then at block 115, the gamer can decide if she/he would like to purchase in-game coins. If the gamer purchases in-game coins, then it is determined if the gamer has enough in-game coins to place a bet to continue playing the game as described with respect to block 113. If the gamer does not purchase in-game coins, then the game ends at block 116.

According to certain embodiments, the gamer can purchase in-game coins using a payment toolbar that appears in the game application. The gamer can purchase in-game coins using a credit card, electronic wallet, SMS payment, or some electronic payment service, etc. The gamer can also use the payment toolbar to purchase boosters and power-ups.

Figure 2:
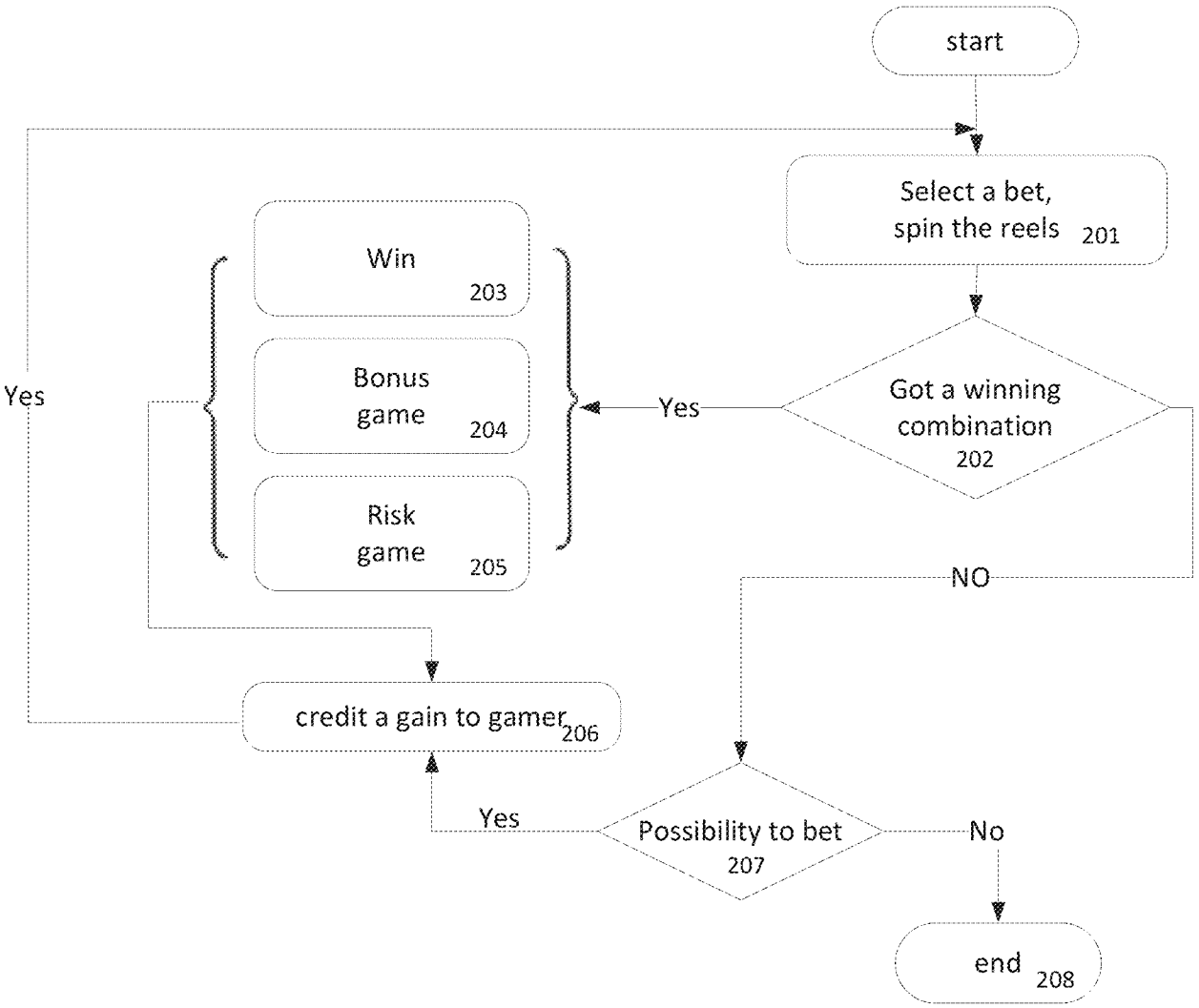
FIG. 2 is a high-level flow chart that illustrates aspects of a central function for a start-up reel, according to certain embodiments.

FIG. 2 is a high-level flow chart that illustrates aspects of a central function for reel start-up and crediting a win to a gamer, according to certain embodiments. At block 201, the gamer can select the amount of in-game coins to bet and then spin the reels (reel start-up) of the slots journey game. At block 202, it is determined if the reels have arrived at a winning combination. For example, a result of a winning combination can include: winning in-game coins 203, winning a bonus game offering 204, or winning a risk game 205. The number of in-game coins that is won is calculated based on a pay table and at block 206 the winnings are applied to the gamer's total in-game coins that are available for game play.

If there is no winning combination, then at block 207, it is determined if the gamer has enough in-game coins left in order to place a new bet to continue playing the game. If it is determined that the gamer has enough remaining in-game coins to place a new bet, then the gamer can place another bet and spin the reel again as described with respect to block 201. If it is determined that the gamer does not have any remaining in-game coins, then the game ends at block 208 unless the gamer can purchase more in-game coins or otherwise obtain more in-game coins as previously described.

Figure 3:
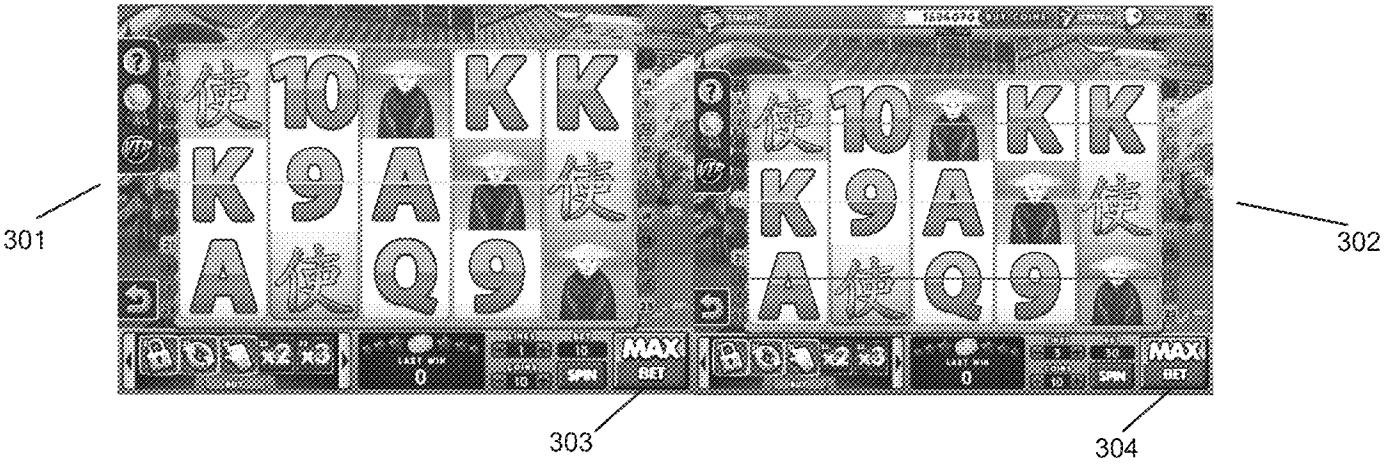
FIG. 3 and FIG. 4 illustrate sample start-up reels showing selection and setting of bets, according to certain embodiments.
Figure 4:
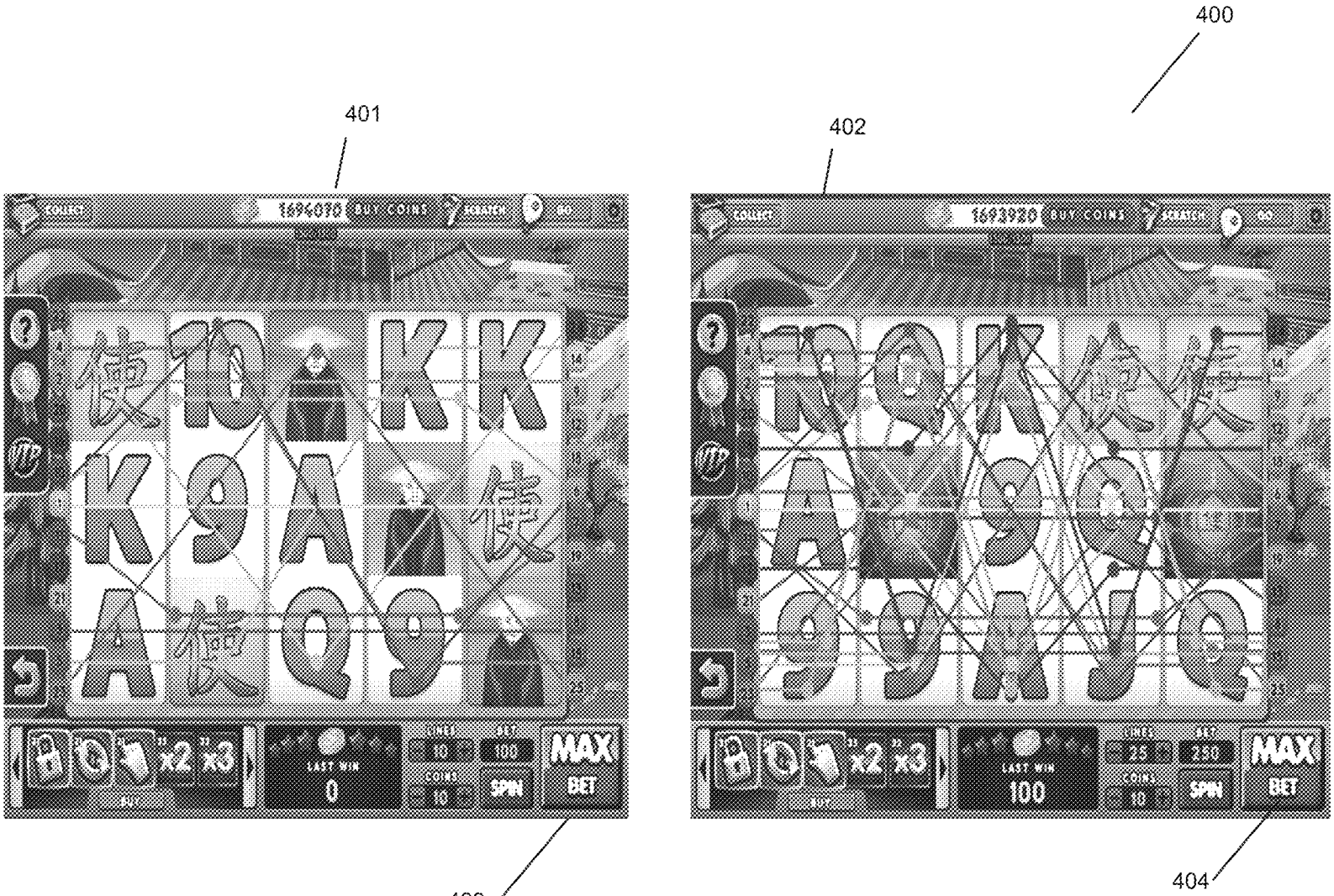

FIG. 3 and FIG. 4 illustrate sample start-up reels showing selection and setting of bets, according to certain embodiments. The gamer can manually select the number of lines and the amount of coins she/he would like to bet for each line. FIG. 3 shows a sample play with one line on the reel selected 301 and three lines on the reel selected 302. FIG. 4 shows a sample play with ten lines on the reel selected 401 and twenty five lines on the reel selected 402. The gamer also has the option of selecting the maximum bet option (see "Max Bet" 303, 304 of FIG. 3 and 403, 404 of FIG. 4).

Figure 5:
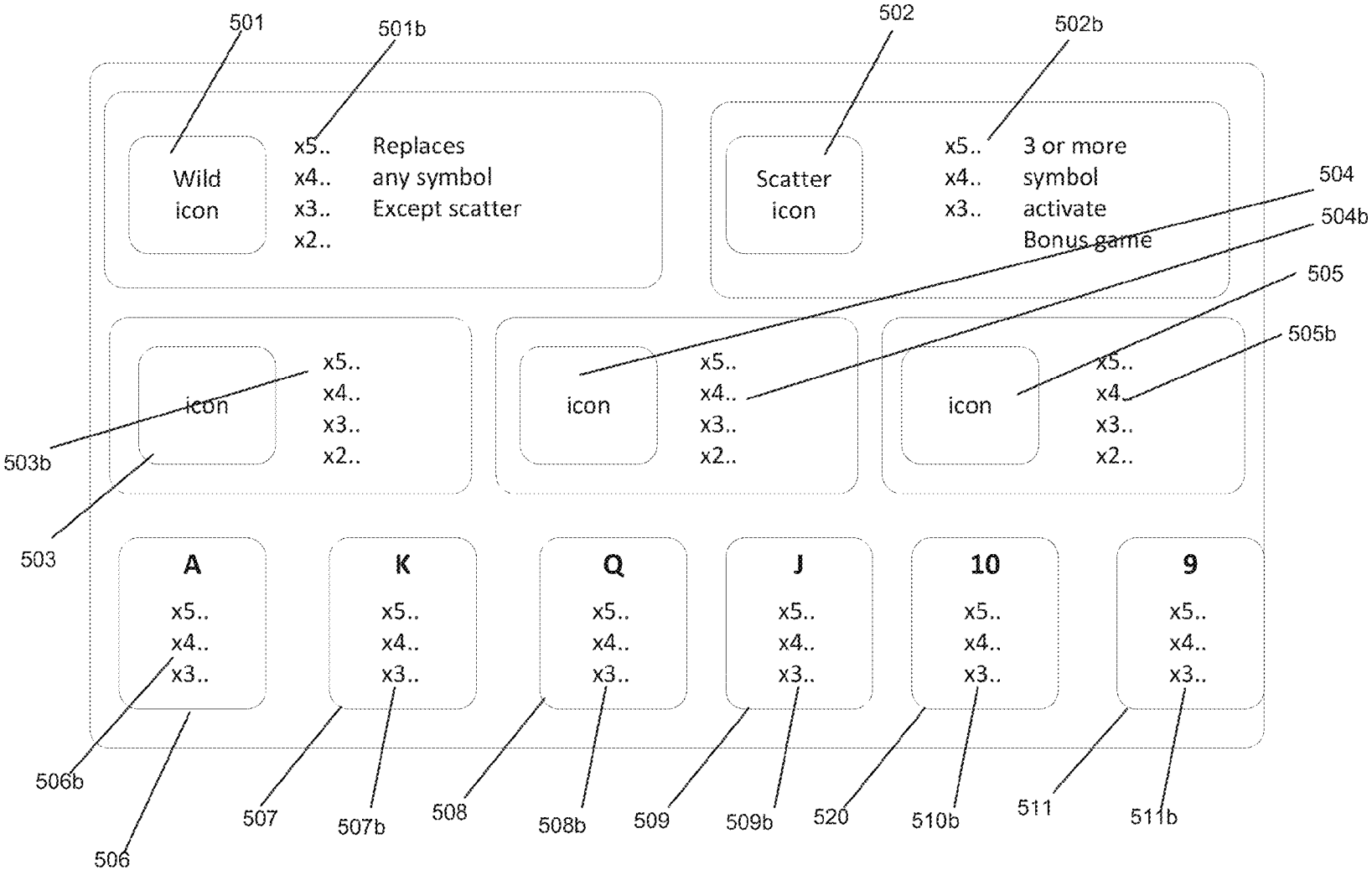
FIG. 5 illustrates a sample pay table, according to certain embodiments.

FIG. 5 illustrates a sample pay table, according to certain embodiments. FIG. 5 shows symbols 501-511. Each symbol is associated with a corresponding set of payouts 501*b*-511*b*, such as payouts for 2 in-a-row, 3 in-a-row, 4 in-a-row, and 5 in-a-row matching symbols. For example, the payout for 3 in-a-row matching symbols is more than the payout for 2 in-a-row matching symbols. According to certain embodiments, symbol 501 is a "wild" symbol. The wild symbol can substitute for any symbol except for the "Scatter" symbol 502. According to certain embodiments, three or more Scatter symbols on a line on the reel activate a bonus game.

Figure 6:
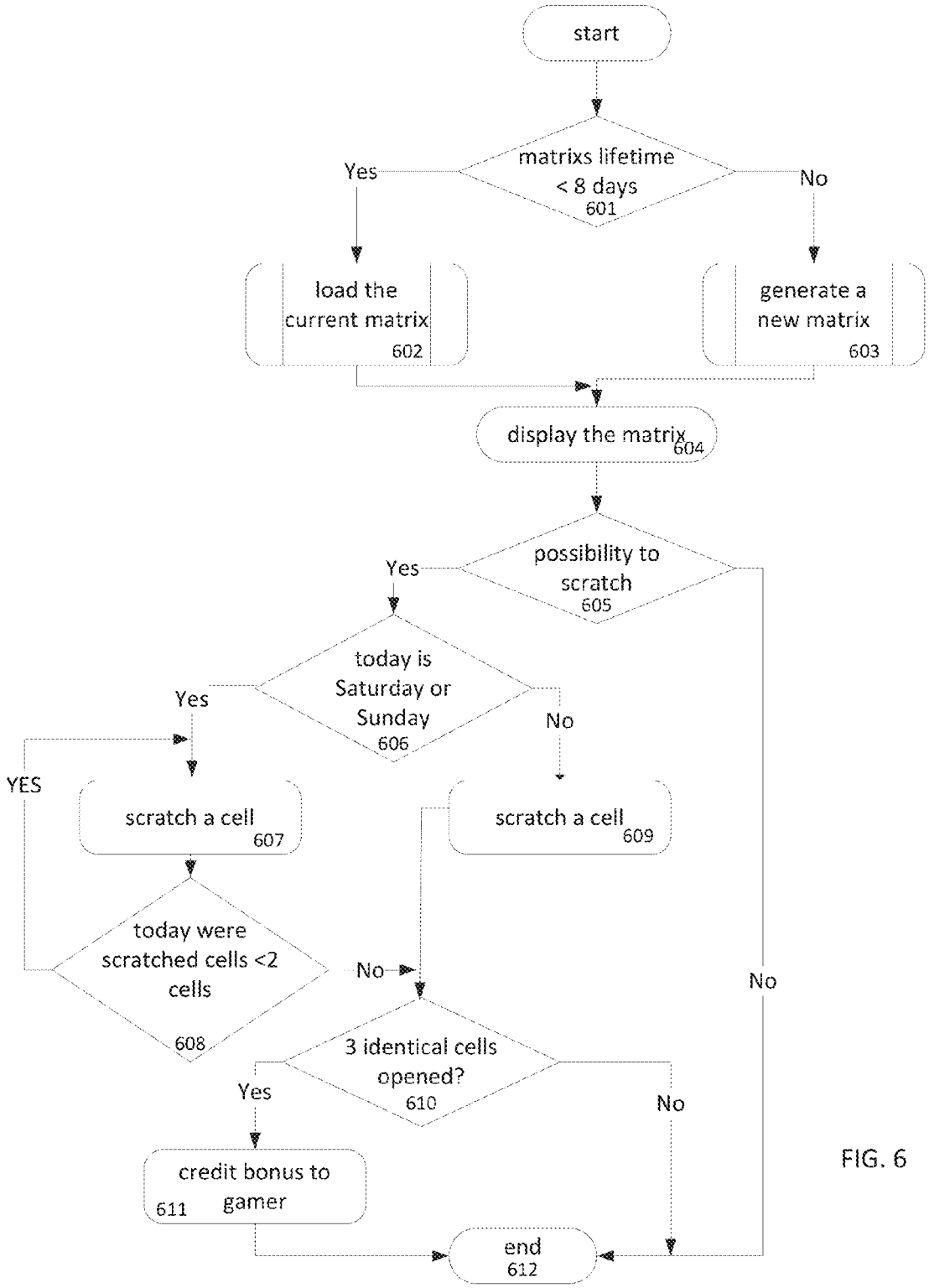
FIG. 6 is a high-level flow chart that illustrates a scheme for a scratch game, according to certain embodiments.

FIG. 6 is a high-level flow chart that illustrates a scheme for a scratch game, according to certain embodiments. The scratch game is a type of "daily bonus" game that is part of the slots journey game, according to certain embodiments. At block 601 in FIG. 6, it is determined if the lifetime of the current 3×3 matrix of "scratch" cells is less than 8 days. If the lifetime is less than 8 days, then the current matrix is loaded at block 602. If the lifetime is greater than 8 days, then at block 603, a new 3×3 matrix of "scratch" cells is generated. According to certain embodiments, each week a new 3×3 matrix of "scratch" cells is generated whether or not the cells of the current 3×3 matrix have been scratched opened.

At block 604, the 3×3 matrix of "scratch" cells is displayed to the gamer. At block 605, it is determined if the gamer has the opportunity to scratch a cell. According to certain embodiments, the gamer has the opportunity to scratch only one cell in the matrix once each weekday and two cells on each of Saturday and Sunday. If it is determined that the gamer has no opportunity to scratch a cell, then the scratch game ends at block 612. If it is determined that the gamer has the opportunity to scratch a cell, then at block 606, it is determined if the day is a Saturday or a Sunday. If it is determined that the day is a Saturday or a Sunday, then at block 607, the gamer is allowed to scratch a cell. Then at block 608 it is determined if today the gamer has scratched less than 2 cells. If it is determined that today the gamer has scratched less than 2 cells, then the gamer is allowed to scratch another cell (block 607). If it is determined that today the gamer has scratched at least 2 cells, then at block 610 it is determined if there are at least 3 scratched open cells with identical symbols. If there are at least 3 scratched open cells with identical symbols, then at block 611, a bonus amount of in-games coins are credited to the gamer, after which the game ends at block 612. If there are no 3 scratched open cells with identical symbols, then the game ends at block 612. If at block 606, it is determined that the day is not a Saturday or a Sunday, then at block 609 the gamer is allowed to scratch a cell. Control then passes to block 610 which is described above.

The dice game is another type of "daily bonus" game that is part of the slots journey game, according to certain embodiments. For example, a "treasure map" is displayed and the gamer rolls a dice to move forward on a path (e.g., stepping stones) on the treasure map. Depending on where the dice lands, the gamer can win any of 5 types of point (bonuses). According to certain embodiments, the 5 types of points are: 1) Simple points—a bonus amount of in-game coins are credited to the gamer according to the established rules of the game; 2) Gift booster—a bonus amount of in-game coins and a booster are credited to the gamer according to the established rules of the game; 3) Gamer's win multiplier—the gamer wins a multiplier for her/his points which he/she has won; 4) Additional move—the gamer wins the opportunity to roll the dice to move one additional step; 5) Multiple moves—the gamer wins the opportunity to move several additional steps. According to certain embodiments, if the gamer advances through the whole path (all the steps on the path) of the treasure map, then a bonus amount of in-game coins and three booster are credited to the gamer for game playing. According to certain embodiments, the gamer is given the opportunity to advance one step for free per day (allowed to roll the dice once for free per day). The gamer can also purchase additional opportunities to roll the dice in order to advance on the treasure map.

Figure 7:
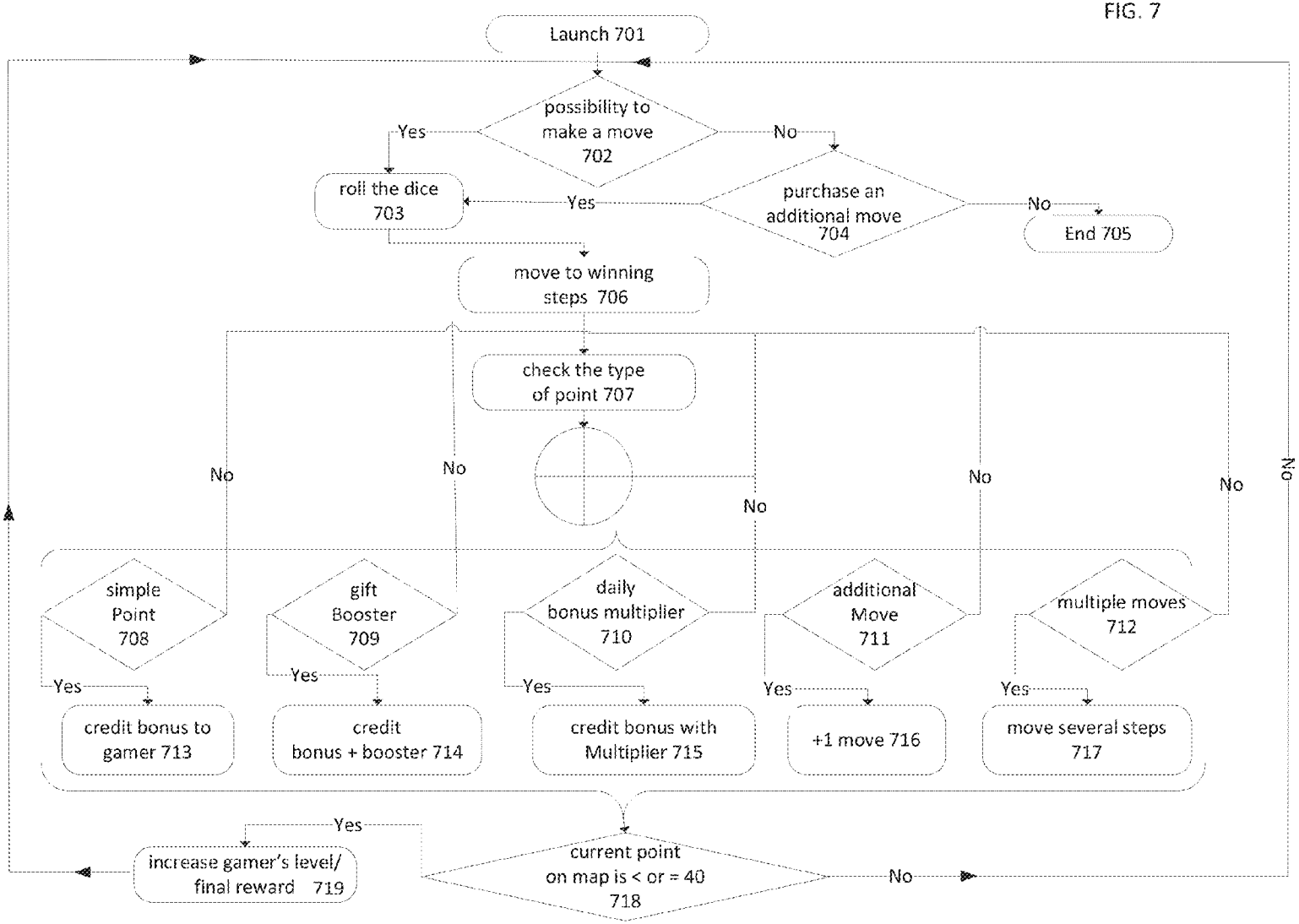
FIG. 7 is a high-level flow chart that illustrates a scheme for a dice game, according to certain embodiments.

FIG. 7 is a high-level flow chart that illustrates a scheme for the dice game, according to certain embodiments. At block 701, the rolling dice game is launched. At block 702 it is determined if the gamer has an opportunity to roll the dice (to advance a step on the map). If it is determined that the gamer does not have an opportunity to roll the dice, then at block 704, it is determined if the gamer wishes to purchase an opportunity to roll the dice. If the gamer does not wish to purchase an opportunity to roll the dice, then the rolling dice game ends at block 705. If at block 702 it is determined that the gamer has an opportunity to roll the dice (or the gamer has purchased an opportunity to roll the dice at block 704), then the gamer can roll the dice at block 703. At block 706 the gamer advances a predetermined number of winning steps in the map. At block 707, the gamer is credited with the winnings depending on the type of points the gamer has won.

If at block 708, it is determined that the gamer has won "simple points", then a bonus amount of in-game coins are credited to the gamer according to the established rules of the game at block 713.

If at block 709, it is determined that the gamer has won a "gift booster", then a bonus amount of in-game coins and a booster are credited to the gamer according to the established rules of the game at block 714.

If at block 710, it is determined that the gamer has won a "daily bonus multiplier", then the gamer wins a multiplier for her/his points at block 715.

If at block 711, it is determined that the gamer has won an "additional move", then the gamer wins the opportunity to roll the dice to move one additional step on the map at block 716.

If at block 712, it is determined that the gamer has won "multiple moves", then the gamer wins the opportunity to move several additional steps on the map at block 717. At block 718, it is determined if the points based on advancement on the map is greater than or equal to a predetermined number of points. If the points is greater than or equal to a predetermined number of points, then at block 719, the gamer's level and final reward is increased by a predetermined amount and control returns block 702. If the points is not greater than or equal to a predetermined number of points, then control returns to block 702.

According to certain embodiments, if the gamer achieves a "bigwin" winning combination, then the gamer is offered an opportunity to accept or refuse a "risk game." If the gamer refuses the offer to play the risk game, then the bigwin points (in-game coins) are credited to the gamer. In the risk game, the gamer has to guess a number. If the gamer guesses a number that is bigger than the game's number, then the gamer wins and the game points (in-game coins) in the main slots journey game is doubled. If the gamer wins, the gamer is offered another opportunity to double his/her winnings. If the gamer refuses this new offer, then the points (in-game coins) are credited to the gamer. If the gamer accepts this new offer, then a new game number is generated and the gamer has to again guess a number that is greater than the newly generated number in order to win. If the gamer fails to guess an appropriate number then no game points are credited to the gamer and the gamer is returned to the main slots journey game.

Figure 8:
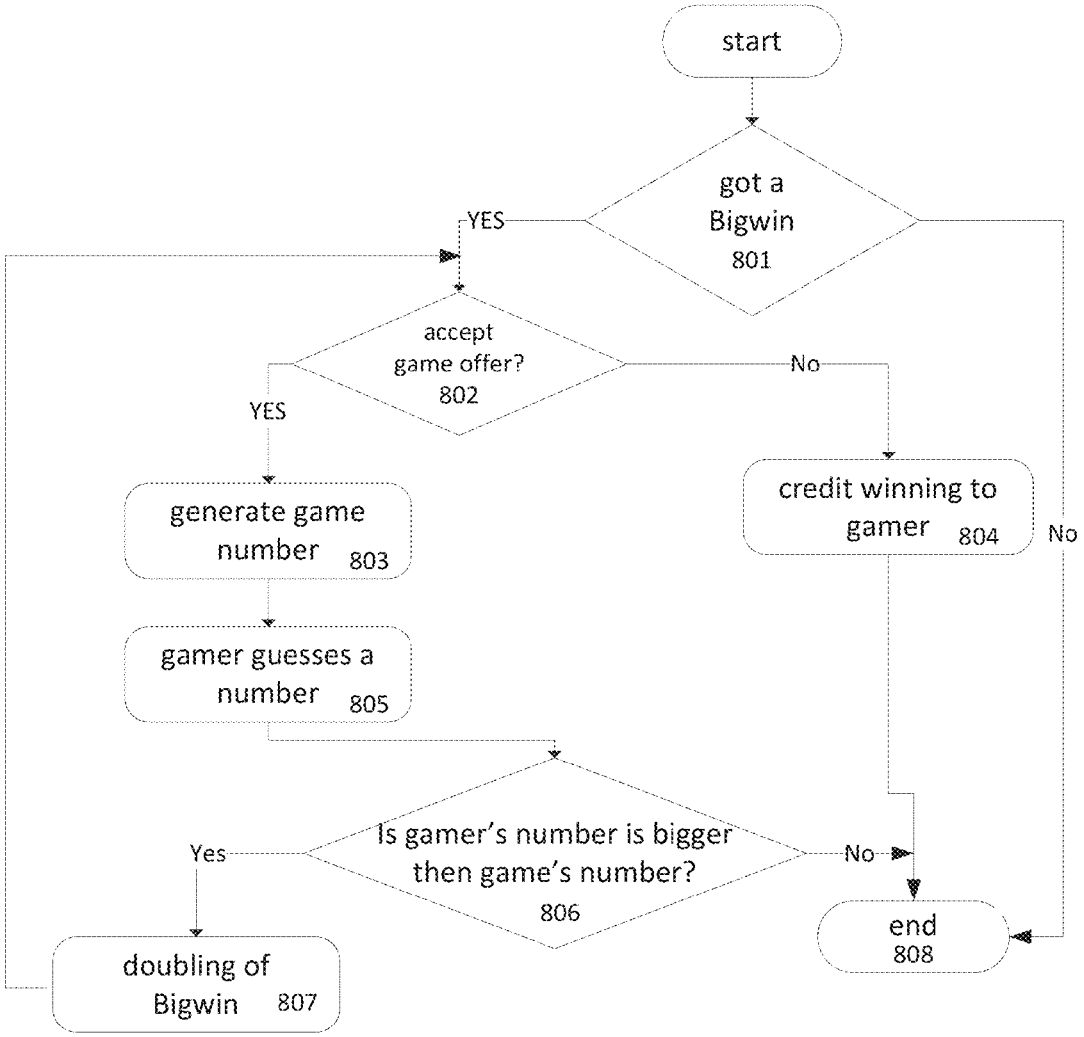
FIG. 8 is a high-level flow chart that illustrates a scheme for a risk game, according to certain embodiments.

FIG. 8 is a high-level flow chart that illustrates a scheme for the risk game, according to certain embodiments. In FIG. 8 at block 801, it is determined if the gamer has won a "bigwin". If it is determined that the gamer has not won a bigwin, then there is no risk game offer. If it is determined that the gamer has won a bigwin, then at block 802, it is determined if the gamer accepts the offer to play the risk game. If the gamer does not accept the offer to play the risk game then at block 804 the bigwin points that the gamer won are credited to the gamer. If the gamer accepts the offer to play the risk game then at block 803, a game number is generated. At block 805, the gamer guesses a number. At block 806, it is determined if the number guessed by the gamer is greater than the game number. If the number guessed by the gamer is not greater than the game number, then no points are credited to the gamer and the gamer is returned to the main slots journey game. If the number guessed by the gamer is greater than the game number, then the gamer's bigwin points are doubled at block 807 and control is passed back to block 802.

Figure 9:
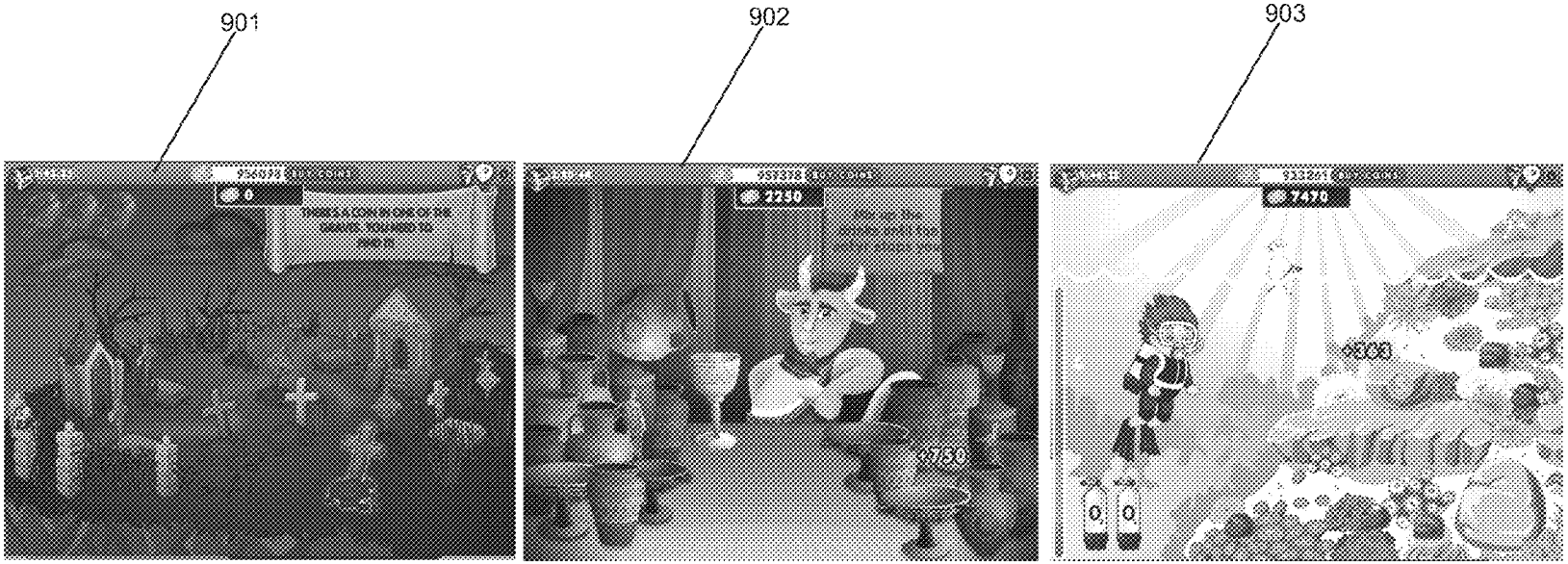
FIG. 9 illustrates sample bonus games, according to certain embodiments.

FIG. 9 illustrates some sample bonus games, according to certain embodiments. FIG. 9 shows sample bonus games 901, 902 and 903. According to certain embodiments, the gamer wins a bonus game when a winning combination of 3 or more "scatter" icons appear on the reel in the slots journey game. In a given bonus game, the gamer is presented with an array of elements on a panel and each element is associated with a predetermine number of points. When the gamer opens an element, the gamer wins the points that are associated with that particular element. According to certain embodiments, the number of opportunities to open the elements on the panel depends on each bonus game's betting amount.

According to certain embodiments, at each hour, the gamer can collect a predetermined amount of bonus in-game coins (points) for game play. The clock restarts for the hour countdown from the moment when the gamer collected the previous hourly bonus. The amount of hourly bonus depends on the number of levels (worlds, locations) to which the gamer has advanced in the slots journey game. According to certain embodiments, uncollected hourly bonuses are not accumulated and are not carried forward to the next day.

According to certain embodiments, the gamer can obtain bonuses from each of the gamer's friends that have installed the slots journey game or that have registered to play the game on a social media site. The gamer receives an opportunity to make three start-ups of the reel for each friend. The bonus from each friend are credited to the gamer. Uncollected bonuses are not accumulated and are not carried forward to the next day. According to certain embodiments, information on the gamer and the gamer's friends are collected from the gamer's profile at the social media site where the gamer is playing the slots game. Such information is stored at the server database associated with the game.

Figure 10:
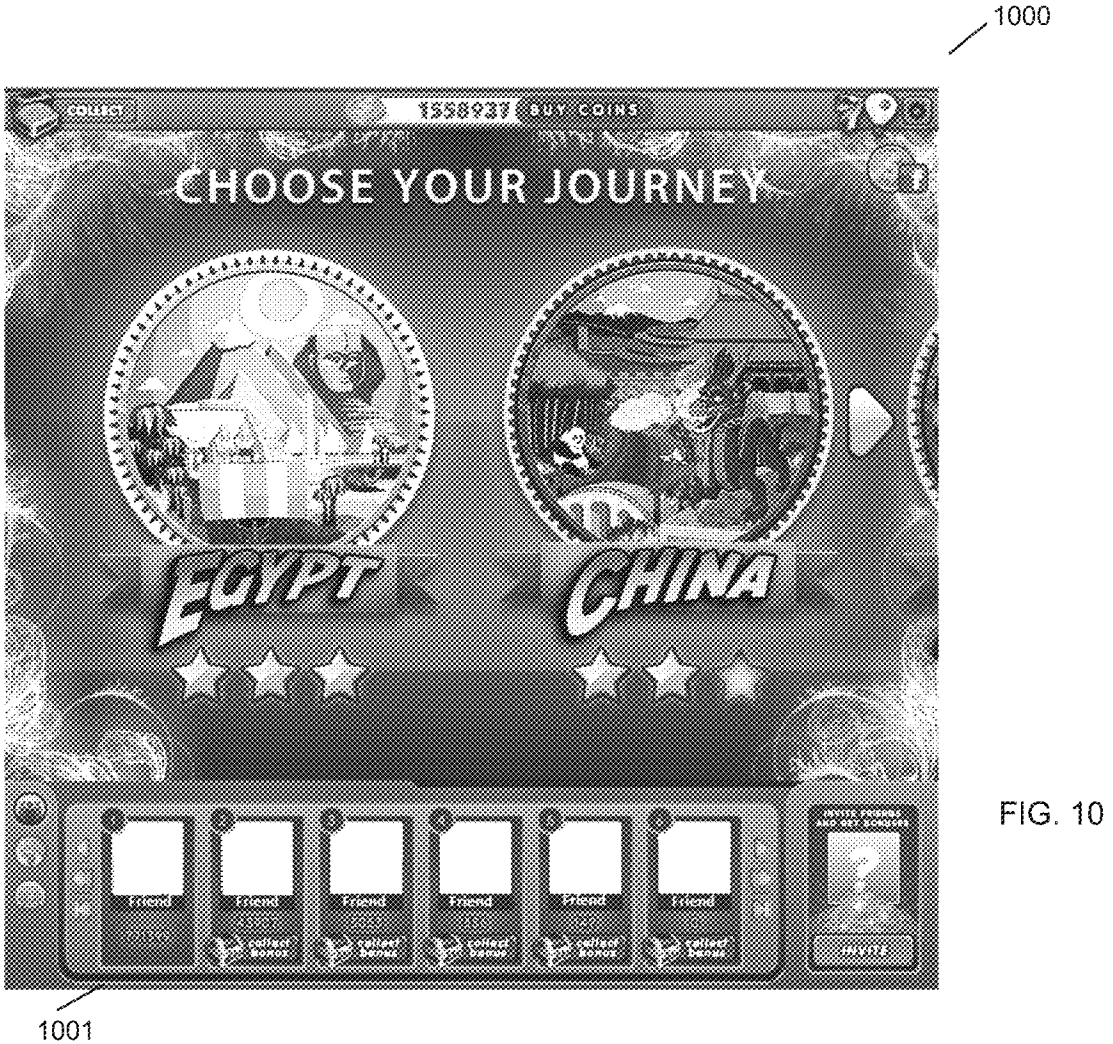
FIG. 10 shows a display of friends and bonuses, according to certain embodiments.

FIG. 10 shows a display of friends and bonuses, according to certain embodiments. FIG. 10 shows a slots journey game 1000 and a toolbar 1001 that displays the gamer's game level, the gamer's friends and corresponding bonuses.

Figure 11:
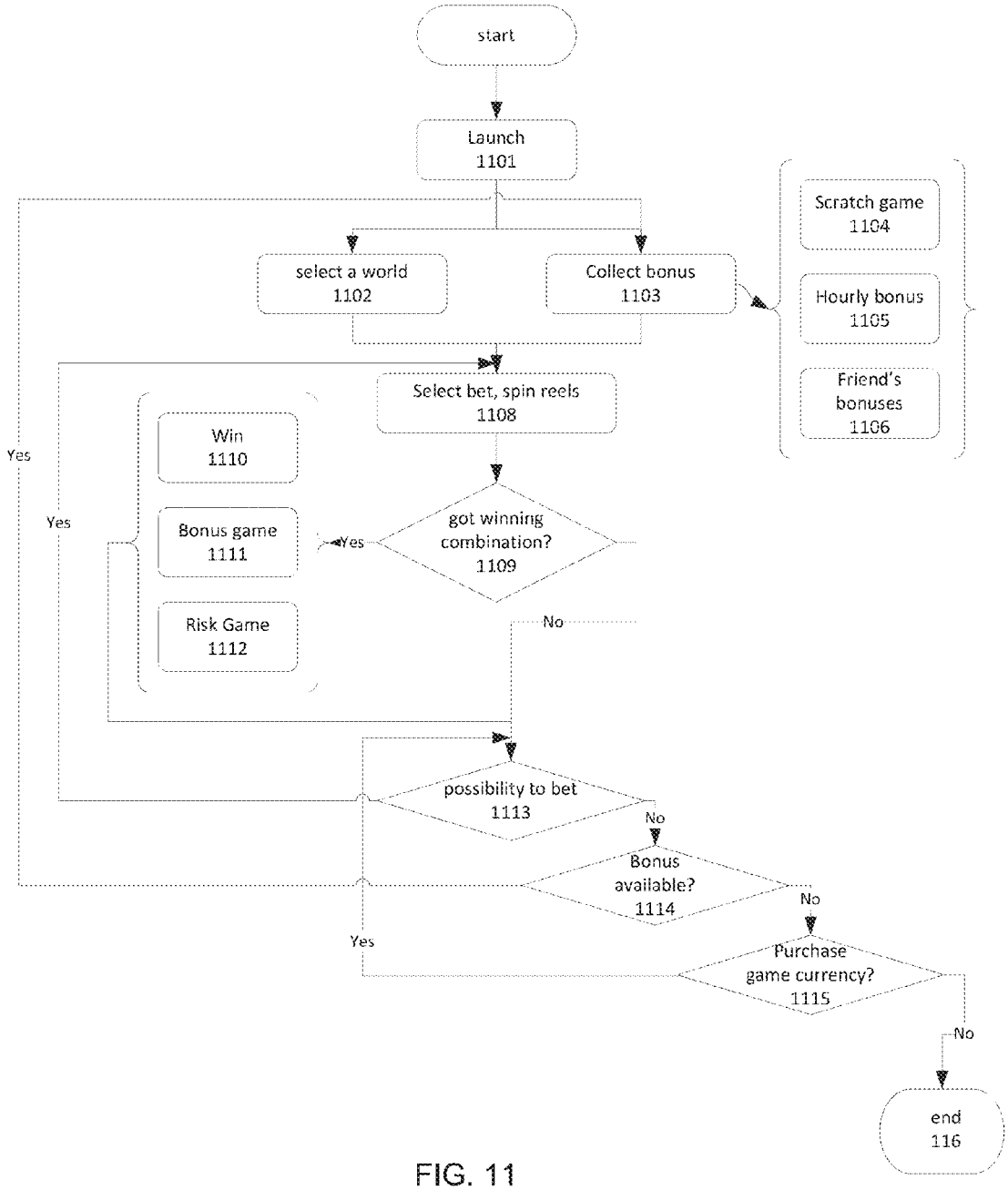
FIG. 11 is a high-level flow chart that illustrates a general scheme for a mobile version of the slots journey game according to certain embodiments.

FIG. 11 is a high-level flow chart that illustrates a general scheme for a mobile version of the slots journey game according to certain embodiments. This scheme is similar to that as described for the social media version except that there is no dice game in the mobile version. In FIG. 11, at block 1101, the slots journey game is launched. The gamer has the option to select a "world" at block 1102, or select the option of collecting bonuses at block 1103. If the gamer selects to collect bonuses then the gamer is presented with a variety of ways to collect bonuses. Some non-limiting examples of collecting bonuses include: a scratch game 1102, an hourly bonus 1105 and friend's bonuses 1106. The scratch game, hourly bonus and friend's bonuses were previously described herein. If the gamer selects a "world", then the gamer can start playing one of several locations and levels within the world. For example, the game starts at the first location and level if the gamer is just starting the game in that particular world or the gamer can resume at the location and level in which he/she was playing previously.

At block 1108, the gamer can select the amount of in-game coins to bet (a bet) and then spin the reels of the slots journey game. At block 1109, it is determined if the reels have arrived at a winning combination. For example, a result of a winning combination can include: winning in-game coins 1110, winning a bonus game offering 1111, or winning a risk game 1112. The number of in-game coins that is won is calculated based on a pay table that is described in greater detail herein.

If there is no winning combination, then at block 1113, it is determined if the gamer has enough in-game coins left in order to place a new bet to continue playing the game. If it is determined that the gamer has enough remaining in-game coins to place a new bet, then the gamer can place a bet and spin the reel again as described with respect to block 1108. If it is determined that the gamer does not have enough remaining in-game coins, then at block 1114 it is determined if there are any bonuses available to the gamer. If it is determined there are bonuses available, then the gamer can collect bonuses as described with respect to block 1103. If it is determined there are no bonuses available, then at block 1115, the gamer can decide if she/he would like to purchase in-game coins. If the gamer purchases in-game coins, then it is determined if the gamer has enough in-game coins to place a bet to continue playing the game as described with respect to block 1113. If the gamer does not purchase in-game coins, then the game ends at block 1116.

According to certain embodiments, the gamer can purchase in-game coins using a payment toolbar that appears in the game application. The gamer can purchase in-game coins using a credit card, electronic wallet, SMS payment, or some electronic payment service, etc. The gamer can also use the payment toolbar to purchase boosters and power-ups.

Figure 12:
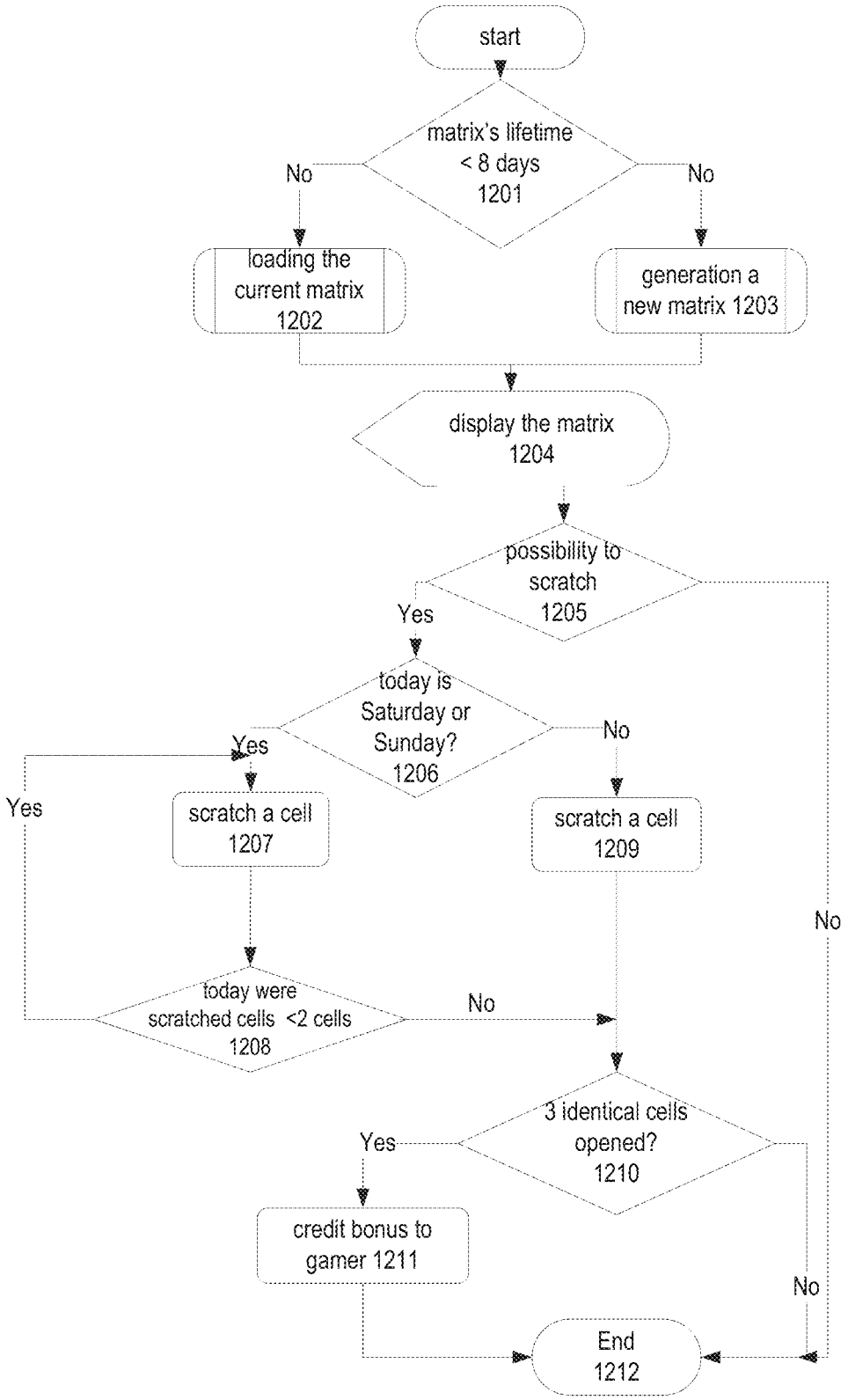
FIG. 12 is a high-level flow chart that illustrates a mobile version of the scratch game, according to certain embodiments.

FIG. 12 is a high-level flow chart that illustrates a mobile version of the scratch game, according to certain embodiments. This scheme is similar to that as described for the social media version. At block 1201 in FIG. 12, it is determined if the lifetime of the current 3×3 matrix of "scratch" cells is less than 8 days. If the lifetime is less than 8 days, then the current matrix is loaded at block 1202. If the lifetime is greater than 8 days, then at block 1203, a new 3×3 matrix of "scratch" cells is generated. According to certain embodiments, each week a new 3×3 matrix of "scratch" cells is generated whether or not the cells of the current 3×3 matrix have been scratched opened.

At block 1204, the 3×3 matrix of "scratch" cells is displayed to the gamer. At block 1205, it is determined if the gamer has the opportunity to scratch a cell. According to certain embodiments, the gamer has the opportunity to scratch only one cell in the matrix once each weekday and two cells on each of Saturday and Sunday. If it is determined that the gamer has no opportunity to scratch a cell, then the scratch game ends at block 1212. If it is determined that the gamer has the opportunity to scratch a cell, then at block 1206, it is determined if the day is Saturday or Sunday. If it is determined that the day is Saturday or Sunday, then at block 1207, the gamer is allowed to scratch a cell. Then at block 1208 it is determined if today the gamer has scratched less than 2 cells. If it is determined that today the gamer has scratched less than 2 cells, then the gamer is allowed to scratch another cell (block 1207). If it is determined that today the gamer has scratched at least 2 cells, then at block 1210 it is determined if there are at least 3 scratched open cells with identical symbols. If there are at least 3 scratched open cells with identical symbols, then at block 1211, a bonus amount of in-games coins are credited to the gamer, after which the game ends at block 1212. If at block 1206, it is determined that the day is not the Saturday or Sunday, then at block 1209 the gamer is allowed to scratch a cell. Control then passes to block 1210 which is described above.

According to certain embodiments, the mobile version of the risk game is similar to the social media version of the risk game.

Figure 13:
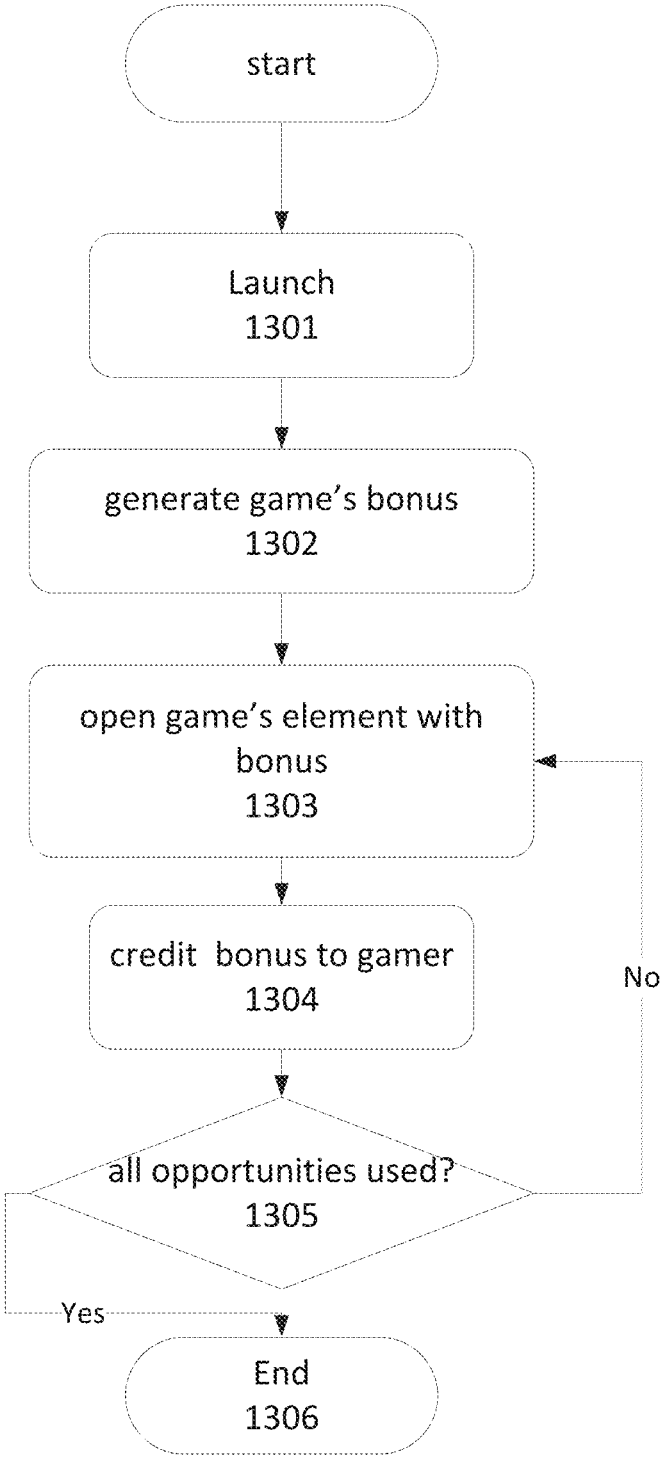
FIG. 13 is a high-level flow chart that illustrates a mobile version of the bonus game, according to certain embodiments.

FIG. 13 is a high-level flow chart that illustrates a mobile version of the bonus game, according to certain embodiments. In FIG. 13, at block 1301, the bonus game is launched. At block 1302, the game's bonuses are generated. At block 1303, the gamer opens elements in the game. At block 1304, the points of the opened elements are credited to the gamer. At block 1305, it is determined if the gamer has used up all his opportunities for opening elements. If the gamer has not used up all his opportunities for opening elements, then control is passed back to block 1303. However, if the gamer has used up all his opportunities for opening elements, then the bonus game ends at 1306.

According to certain embodiments, the mobile version of the hourly bonus is similar to the social media version of the hourly bonus.

According to certain embodiments, the mobile version of the friend's bonus is similar to the social media version of the friend's bonus except that the winning combination of a spin is multiplied by the number of friends that made not less than one start-up of the reel since the time that the game was set.

Figure 14:
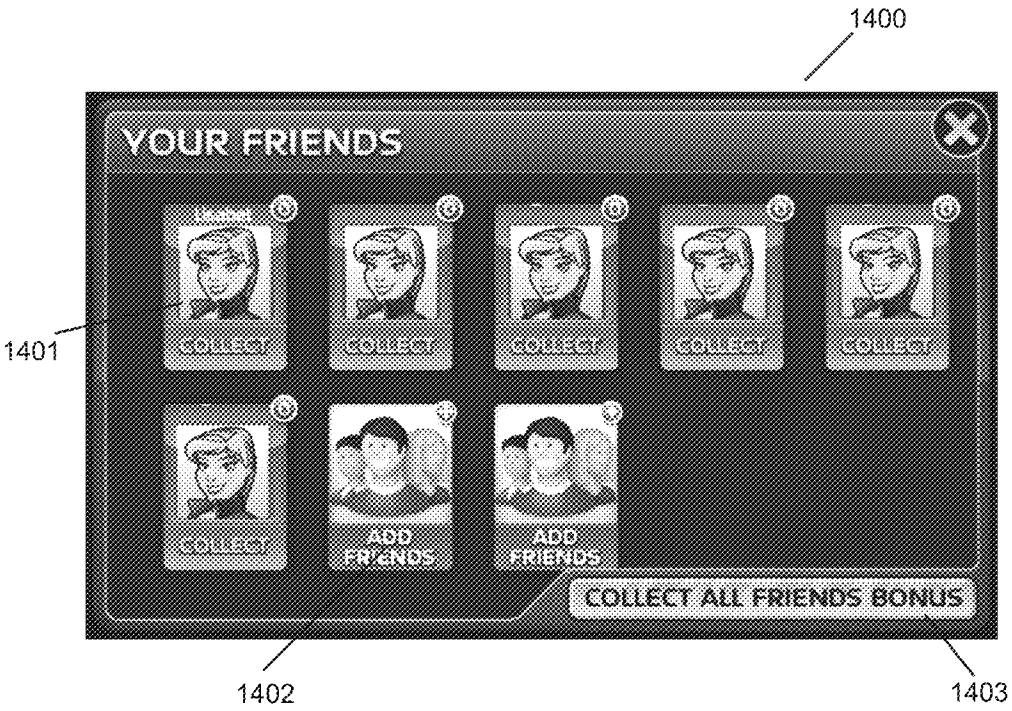
FIG. 14 shows a sample interface for collecting friend's bonuses, according to certain embodiments.

FIG. 14 shows a sample interface for collecting friend's bonus, according to certain embodiments. FIG. 14 show a display 1400 of the gamer's friends 1401 and corresponding bonuses. The gamer can add friends by activating 1402 and can collect all friends' bonuses by activating option 1403.

Figure 15:
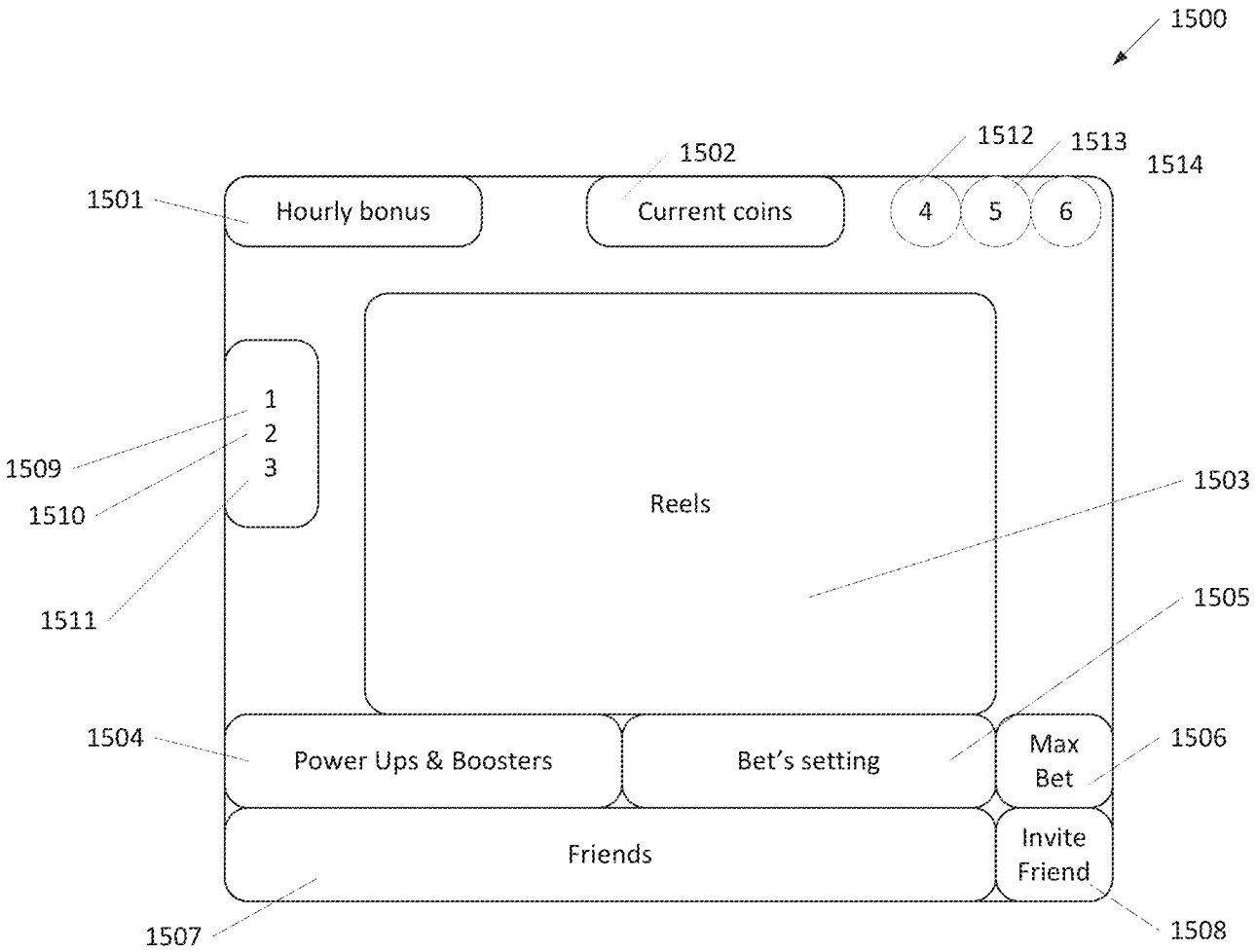
FIG. 15 illustrates a game interface model, according to certain embodiments.

FIG. 15 illustrates a game interface model, according to certain embodiments. FIG. 15 shows a game interface model 1500 that includes an hourly bonus feature 1501, current amount of in-game coins 1502 that the gamer has, a reel area 1503, power-ups & boosters features 1504, a bet setting area 1505, a maximum bet feature 1506, tool bar 1507 display of gamer's friends, an "invite friend" feature 1508, a pay table feature 1509, a table of achievements feature 1510, a VIP club feature 1511, a scratch game feature 1512, a dice game feature 1513, a game settings feature 1514 (e.g., sound control music, quality, image quality).

According to certain embodiments, the table of achievements includes highlights of the gamer' winnings at a given level of the game, such as 4 in-a-row, 5 in-a-row, boosters etc. The gamer may get in-game coins and boosters as a gift if the table of achievements is full, according to certain embodiments.

According to certain embodiments, the gamer can purchase a VIP club membership. According to certain embodiments, a VIP club membership provides the gamer with benefits that include: 1) an hourly bonus+10%, 2) ability to obtain daily "friend's bonus" at one click, 3) extra feature (ability to get more bonuses), 4) a predetermined number of additional coins per month, and 5) a "big pack" of boosters per month.

According to certain embodiments, the slots journey game includes various "worlds" that the gamer can access for playing the game. Each world includes a number of locations, and each location includes a number of levels, for example. When a gamer plays the game for the first time, the gamer can access only one world (for example, Egypt).

Figure 16:
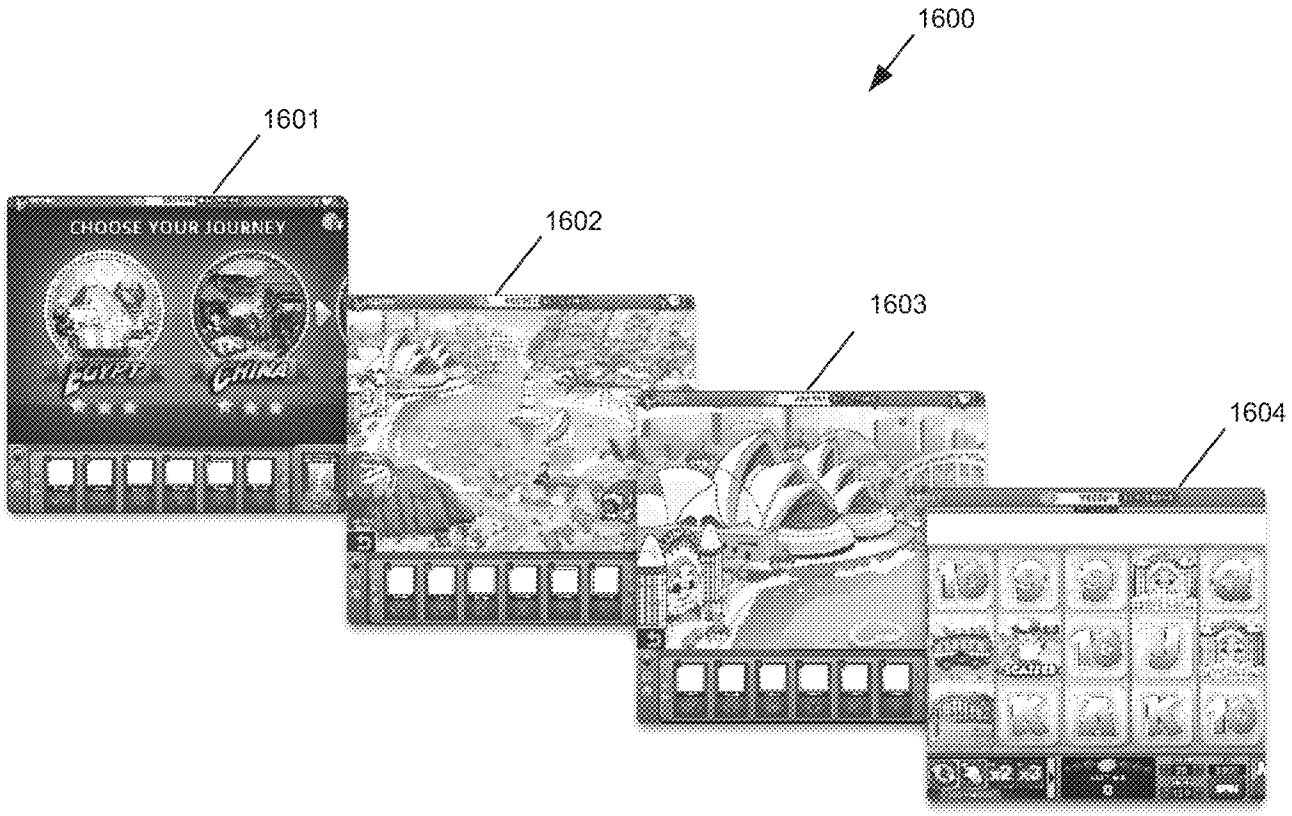
FIG. 16 illustrates sample "worlds" and "locations" features of the slots journey game, according to certain embodiments.

FIG. 16 illustrates a sample 1600 of "worlds", "locations" and "levels" features of the slots journey game, according to certain embodiments. FIG. 16 shows worlds 1601, location 1602 within a world, levels 1603 within a location, and the slots game 1604 at a given level.

According to certain embodiments, when a world is selected, a map of various locations associated with that world is displayed. When a location is selected, a map of the levels (steps) within the selected location is displayed. The gamer can advance to the next location upon completing all the levels of the preceding location. In order to advance to the next level, the gamer needs to score a predetermined number of points, according to certain embodiments. The number of points is based on the level that the gamer is playing. The gamer can access the next world only after the gamer has played all the locations of the preceding world.

According to certain embodiments, the slots journey game includes a star rating system. One function of the star rating system is to hold the interest of gamers, especially those gamers that play the game for long periods at a time. For example, a gamer earns a star for successfully completing each world and its associated locations and levels. When the gamer completes the third world, she/he earns the third star. The gamer can earn a rating point when she/he completes each level in a given location. Gamers that earn a large number of rating points for a given world become "ratings leaders." The ratings leaders are ranked based on their rating points and the ratings leaders are displayed on a leader board. According to certain embodiments, the rating leaders in each world are given an opportunity to raise their rate (+30, for example).

According to certain embodiments, the game provides interest to a gamer by offering the gamer an opportunity to increase his/her chances of winning using power-ups. There are different types of power-ups that include: 1) restart all the reels except one reel that is selected by the gamer, 2) restart one reel that is selected by the gamer, and 3) change the position of the selected reel one position up or down. Boosters allow the gamer to multiply her/his winnings and thus provide an enhanced gamer experience. For example, booster can be ×2, ×3, ×4, ×5, ×10, ×20.

According to certain embodiments, the game provides a "hold" feature for stopping a reel from spinning when the gamer clicks on the "hold" button.

According to certain embodiments, the game includes several methods of monetization including: 1) sale of in-game coins for game play, and 2) sale of game items wherein the items can influence the game process. Such game items can include:

1) A dice game whereby a gamer can purchase additional moves if the gamer would like to get more than the one daily free move.

2) Friend's assistance whereby a gamer can earn another "star" by asking a friend for assistance in providing extra hours to the gamer in order to provide the gamer more time to complete the world. The gamer also has the option to purchase the friend's hours.

3) Sale of bonuses such as VIP Club membership, boosters and power-ups as previously described herein.

According certain embodiments, the game includes features to produce viral effects. Such features include inviting friends to play the game and sharing achievement information with friends. For example, the presence of friends in the game allows the gamer to speed up the levels of achievement, receive daily bonuses from the friends, increase the time available to complete a given task in the game, and send gifts to or receive gifts from friends.

Figure 17:
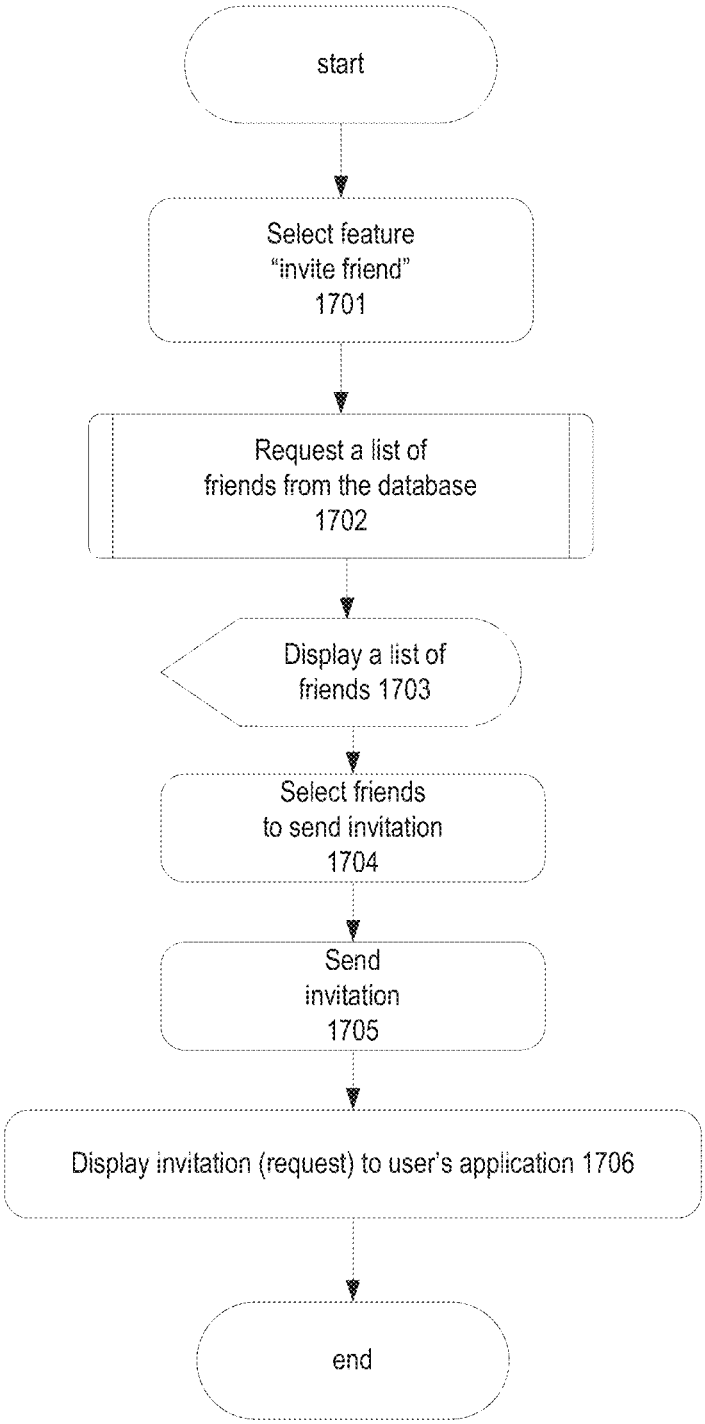
FIG. 17 is a high-level flow chart that illustrates the "invite friends" feature, according to certain embodiments.

FIG. 17 is a high-level flow chart that illustrates the "invite friends" feature, according to certain embodiments. At block 1701, the gamer can select the "invite friend" feature. At block 1702, the game requests a list of the gamer's friends from the database. At block 1703, the list of friends is displayed in the game. At block 1704, the gamer can select friends to which an invitation can be sent to join the game. At block 1705, invitations are sent to the selected friends. At block 1706 the selected friends can see and can accept the invitation in their Facebook top panel, for example.

Figure 18:
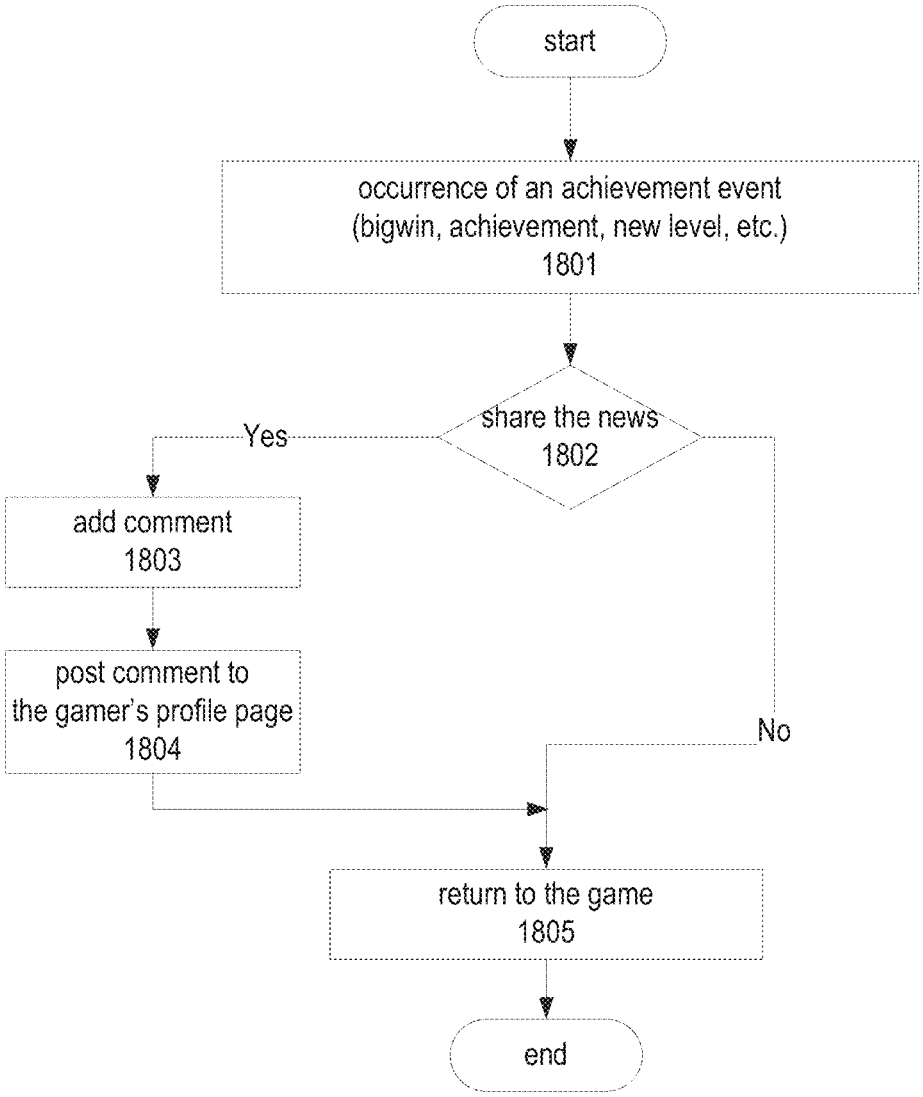
FIG. 18 is a high-level flow chart that illustrates the "share" feature, according to certain embodiments.

FIG. 18 is a high-level flow chart that illustrates the "share" feature, according to certain embodiments. According to certain embodiments, the gamer can post information of her/his game winnings and achievements (e.g. level of achievement, bigwin, and awards) on the gamer's wall. In FIG. 18, at block 1801, an achievement event occurs. At block 1802, the gamer is given the option to share information on the achievement. If the gamer selects the option to share the information, then at block 1803 the gamer can add a comment. At block 1804, the comment is posted to the gamer's profile page. At block 1805, the gamer is returned to the game. If at block 1802, the gamer decides not to select the option to share the achievement information, then control passes to block 1805 whereby the gamer is returned to the game.

Figure 19:
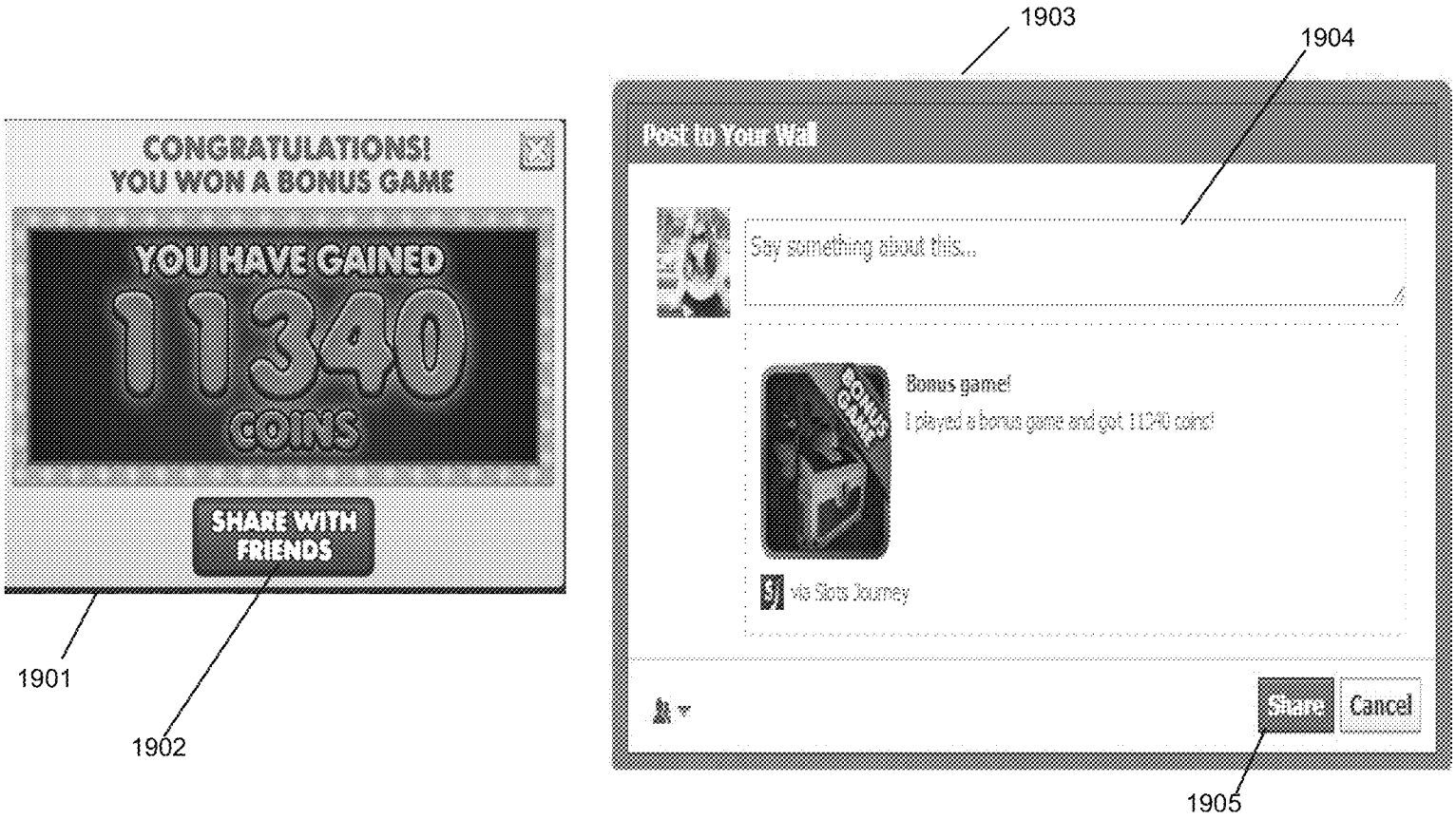
FIG. 19 illustrates samples of the share application, according to certain embodiments.

FIG. 19 illustrates samples of the share application, according to certain embodiments. FIG. 19 shows an achievement occurrence 1901 and a "share with friends" feature 1902. FIG. 19 also shows a gamer's profile page 1903, gamer's wall 1904 and a share option 1905.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

I claim:

1. A non-transitory computer readable medium with executable instructions stored thereon executed by a computer processor to perform a method comprising:

retrieving, over a communications network, a list of friends based on information stored in a social data repository of a first user associated with a social media slots game, the list of friends including one or more second users, the one or more second users having installed the social media slots game on a respective computing device or being registered to play the social media slots game on a social media site;

simulating gambling slots reels in a session of the social media slots game, wherein the first user can spin the simulated gambling slots reels a number of times during the session of the social media slots game, the number of times being based on a number of the one or more second users included in the list of friends;

presenting a plurality of adventure elements in the session of the social media slots game, the plurality of adventure elements enabling the first user to traverse through at least one virtual world of a plurality of virtual worlds by advancing from location to location of a plurality of locations within the at least one virtual world upon scoring a predetermined number of points while playing the social media slots game, the plurality of virtual worlds representing geographic regions; and presenting a plurality of virality elements in the session of the social media slots game, the plurality of virality elements enabling the first user to invite one or more third users to play the social media slots game.

2. The non-transitory computer readable medium of claim 1, wherein the method further comprises providing a star rating feature, wherein the first user receives a star for successfully advancing through all corresponding locations and levels in each world of the social media slots game.

3. The non-transitory computer readable medium of claim 1, wherein the method further comprises providing a power-up feature, wherein the power-up feature comprises at least one of: restart of all reels associated with the social media slots game except one reel selected by the first user, restart one reel selected by the first user, change position of a reel selected by the first user.

4. The non-transitory computer-readable medium of claim 1, wherein the method further comprises providing at least one booster before the first user spins the gambling slots reels in the social media slots game, wherein the at least one booster has the effect of multiplying the first user's winnings from spinning the gambling slots reels in the social media slots game.

5. The non-transitory computer readable medium of claim 1, wherein the method further comprises providing a dice game wherein the first user can purchase additional rolls of the dice.

6. The non-transitory computer readable medium of claim 1, wherein the method further comprises providing sale of a predetermined number of in-game coins per month.

7. The non-transitory computer readable medium of claim 1, wherein the method further comprises providing sale of a single booster.

8. The non-transitory computer readable medium of claim 1, wherein the method further comprises providing sale of a pack of a predetermined number of boosters.

9. The non-transitory computer readable medium of claim 1, wherein the method further comprises providing sale of a single power-up.

10. The non-transitory computer-readable medium of claim 1, wherein the method further comprises providing a pack of a predetermined number of power-ups, wherein a power-up changes positions of one or more of the simulated gambling slots reels before presenting the plurality of adventure elements.

11. The non-transitory computer readable medium of claim 1, wherein the method further comprises providing a scratch game to obtain in-game coins for playing the social media slots game.

12. The non-transitory computer readable medium of claim 1, wherein the method further comprises providing an offer to play a risk-game, wherein the first user can risk losing the first user's winnings or doubling the winnings.

13. The non-transitory computer-readable medium of claim 1, wherein the method further comprises offering a bonus game for winning in-game coins as part of playing the social media slots game, the bonus game offered during the session of the social media slots game.

14. The non-transitory computer-readable medium of claim 1, wherein the presenting the plurality of virality elements includes providing an ability to invite friends online to the social media slots game.

15. The non-transitory computer-readable medium of claim 1, wherein the presenting the plurality of virality elements includes providing an ability to share information online of winnings and awards with friends.

16. The non-transitory computer-readable medium of claim 1, wherein playing the social media slots game comprises playing different sessions of the social media slots game.

* * * * *